US010557675B1

(12) United States Patent
Robinson et al.

(10) Patent No.: US 10,557,675 B1
(45) Date of Patent: Feb. 11, 2020

(54) DEVICES FOR RESTRICTING THE FLOW OF PROPELLANT GAS IN GAS-ACTUATED FIREARMS

(71) Applicant: WHG Properties, LLC, North Wales, PA (US)

(72) Inventors: Frank E. Robinson, Schwenksville, PA (US); William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 16/047,867

(22) Filed: Jul. 27, 2018

(51) Int. Cl.
*F41A 5/28* (2006.01)
*F41A 5/24* (2006.01)

(52) U.S. Cl.
CPC . *F41A 5/28* (2013.01); *F41A 5/24* (2013.01)

(58) Field of Classification Search
CPC ..... F42B 5/28; F42B 5/24
USPC ..... 89/193
See application file for complete search history.

(56) References Cited

U.S. PATENT DOCUMENTS

| | | | | |
|---|---|---|---|---|
| 8,807,011 | B2 * | 8/2014 | Langevin | F41A 5/24 89/193 |
| 8,973,483 | B2 | 3/2015 | Sullivan | |
| 9,803,941 | B2 * | 10/2017 | LaRue | F41A 5/28 |
| 9,857,129 | B1 | 1/2018 | Kelly et al. | |
| 9,903,675 | B2 * | 2/2018 | Cassels | F41A 5/28 |
| 2013/0055883 | A1 * | 3/2013 | Cassels | F41A 5/28 89/193 |
| 2014/0190344 | A1 * | 7/2014 | Kenney | F41A 5/28 89/193 |
| 2016/0178299 | A1 * | 6/2016 | Cassels | F41A 5/28 89/193 |
| 2018/0180370 | A1 | 6/2018 | Zheng | |

* cited by examiner

*Primary Examiner* — Samir Abdosh
(74) *Attorney, Agent, or Firm* — Fox Rothschild LLP

(57) ABSTRACT

Gas block assemblies for use with gas-actuated firearms include a flow-restrictor device that permits variation of the flow of propellant gas to the action of the firearm. The flow-restrictor device is switchable between a first position at which the device restricts the flow, and a second position at which the device does not present any restriction to the flow. In addition, the flow restrictor device can be configured to permit adjustments in the degree of flow restriction generated when the flow-restrictor device is in its first position.

24 Claims, 10 Drawing Sheets

DEVICES FOR RESTRICTING THE FLOW OF PROPELLANT GAS IN GAS-ACTUATED FIREARMS

STATEMENT OF THE TECHNICAL FIELD

The inventive concepts disclosed herein relate to gas-actuated firearms in which propellant gas generated by the discharge of the firearm is used to actuate an internal mechanism that automatically reloads the firearm.

BACKGROUND

Tactical rifles and other types of firearms commonly are equipped with a gas system configured to capture energy, in the form of high-pressure gas, generated by the discharge of the firearm. The energy is used to activate and cycle a mechanism, or action, that automatically reloads the firearm. Gas-actuated firearms typically include a gas block mounted on a barrel of the firearm. The gas block has a gas port that aligns with a corresponding gas port that is formed in the barrel. The barrel gas port extends between the exterior of the barrel, and an internal bore within the barrel.

When a cartridge, i.e., a round of ammunition, is discharged within a firearm, a projectile of the cartridge is propelled through the bore by high-pressure gas generated by the ignition of propellant within the cartridge. When the propellant gas reaches the barrel gas port, a portion of the propellant gas enters that port. The propellant gas subsequently enters the gas block by way of the gas port formed in the gas block. The propellant gas flows from the gas block gas port into an internal passage formed within the gas block. The pressurized propellant gas then travels to the action of the firearm by way of a gas tube that forms a gas path between the gas block and the action. The action is energized by the propellant gas, and is configured to eject from the firearm the now-empty case of the fired cartridge, strip an unfired cartridge from a magazine of the firearm, and load the unfired cartridge into a chamber of the barrel.

The action is designed to operate when the propellant gas is within particular a range of pressures and flow rates. Under varying circumstances, the pressure of the propellant gas within the bore of the barrel can vary, which in turn can affect the pressure and flow rate of the propellant gas reaching the action. For example, the use of a sound suppressor on a firearm typically raises the gas pressure within the bore. This is due to the increase in back pressure within the bore resulting from the additional flow restriction introduced by the suppressor. The pressure in the bore also can vary with the type of cartridge being fired. Increases in the pressure and flow rate of the propellant gas reaching the action may cause these operating parameters to exceed the levels at which the action is designed to operate, increasing the potential for premature wear and damage to the action, and jamming of the firearm.

Various means have been employed in an attempt to regulate the flow of propellant gas to the action of a gas-operated firearm. For example, the flow of propellant gas has been regulated using gas blocks configured to be moved into different positions on the barrel, so as to align the gas port of the gas block with differently-sized gas ports formed in the barrel. This technique can be problematic, however, because the gas block often becomes stuck to the barrel due to the accumulation of propellant gas residue between the gas block and the barrel.

Other techniques rely on the use of removable sleeves positioned within the gas block, or at other locations in the gas path. The sleeves provide different degrees of flow restriction; and a particular sleeve can be installed when it is necessary or otherwise desired to alter the flow restriction. This technique, however, usually requires cumbersome component disassembly involving the use of external tooling, and also requires that the user have on hand an appropriate sleeve to achieve the desired degree of restriction. Techniques that require disassembly and reassembly and the use of external tooling can be particularly disadvantageous in military and law enforcement applications where flow restriction may need to be adjusted under exigent circumstances, at night or under other low-visibility conditions.

Other flow-restriction techniques employ a flow restriction device that is located within the action, and that provides a different degree of restriction depending on the rotational position of the device. These devices may require external tooling to set the desired level of flow restriction; may remain directly in the gas path at all times, thus introducing an additional flow restriction and pressure drop when not desired; and may not provide the user with positive tactile feedback that a particular degree of flow restriction has been set.

SUMMARY

The present disclosure generally relates to gas block assemblies for firearms.

In one aspect, the disclosed technology relates to gas block assemblies configured for mounting on a barrel of a firearm. The barrel defines a bore configured to receive and guide a projectile as the projectile is propelled through the bore by a propellant gas, and a first gas port extending between the bore and an exterior surface of the barrel.

The gas block assemblies include a gas block defining a first passage configured to receive the barrel; a second passage configured to receive a portion of a gas tube in fluid communication with an action of the firearm; and a second gas port. The second gas port adjoins the second passage, and the gas block is configured so that the second gas port is in fluid communication with the first gas port when the gas block assembly is mounted on the barrel.

The gas block assemblies also include a flow restrictor device mounted on the gas block and having a flow restrictor. At least a first portion of the flow restrictor is positioned within the second passage of the gas block. The flow restrictor is configured to rotate in relation to the gas block between a first position at which the first portion of the flow restrictor covers only a portion of the second gas port, and a second position.

In another aspect, firearms include a barrel that defines a bore configured to receive and guide a projectile as the projectile is propelled through the bore by a propellant gas produced by the firing of the projectile. The barrel also defines a first gas port extending between the bore and an exterior surface of the barrel.

The firearms also include a gas block that defines a first passage configured to receive the barrel; a second passage; and a second gas port. The second gas port adjoins the second passage, and is in fluid communication with the first gas port. The firearms also have a gas-actuated action, and a gas key in fluid communication with the action;

The firearms further include a gas tube in fluid communication with the second passage of the gas block and the gas key. The first and second gas ports, the second passage, the gas tube, and the gas key define a gas supply path operable to direct a portion of the propellant gas from the bore to the action.

The firearms also have a flow restrictor device mounted for rotation on the gas port. The flow restrictor device includes a flow restrictor configured to restrict the flow of the propellant gas through the gas supply passage on a selective basis.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

Embodiments will be described with reference to the following drawing figures, in which like reference numerals represent like parts and assemblies throughout the several views.

DETAILED DESCRIPTION

The inventive concepts are described with reference to the attached figures. The figures are not drawn to scale and are provided merely to illustrate the instant inventive concepts. The figures do not limit the scope of the present disclosure. Several aspects of the inventive concepts are described below with reference to example applications for illustration. It should be understood that numerous specific details, relationships, and methods are set forth to provide a full understanding of the inventive concepts. One having ordinary skill in the relevant art, however, will readily recognize that the inventive concepts can be practiced without one or more of the specific details or with other methods. In other instances, well-known structures or operation are not shown in detail to avoid obscuring the inventive concepts.

Figure 1:
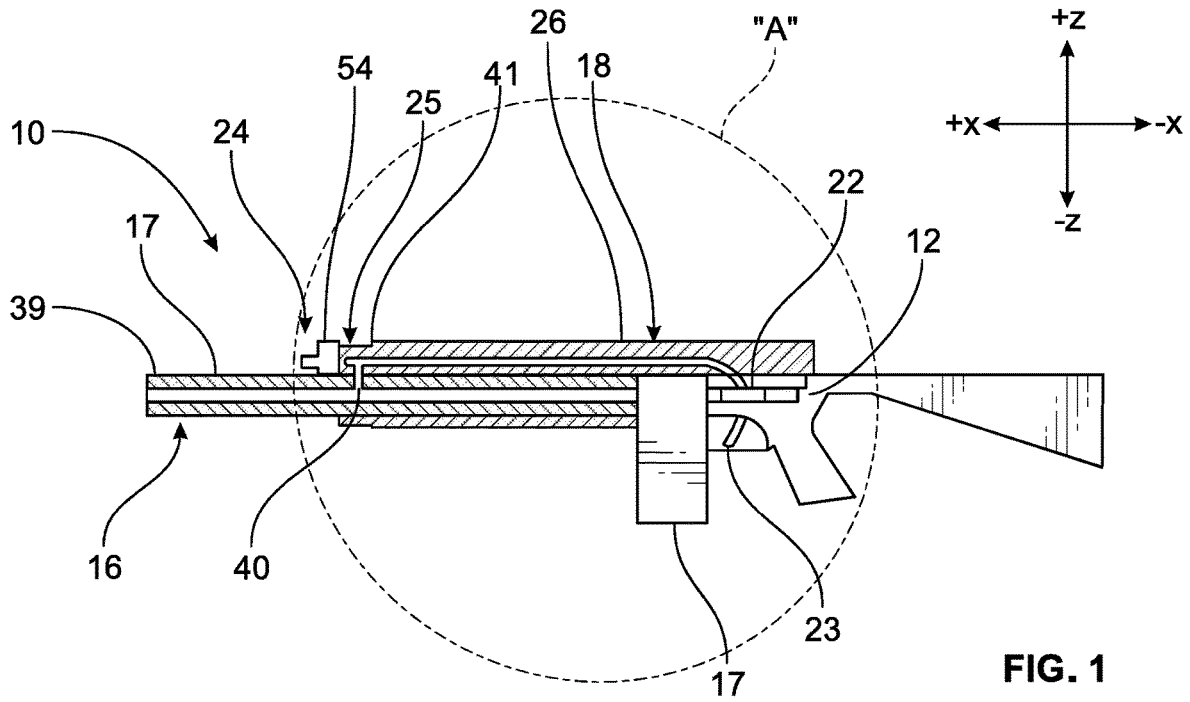
FIG. 1 is a cross-sectional side view of an exemplary firearm equipped with a gas block assembly having a flow restrictor device configured to vary the flow of propellant gas to an action of the firearm.
Figure 2:
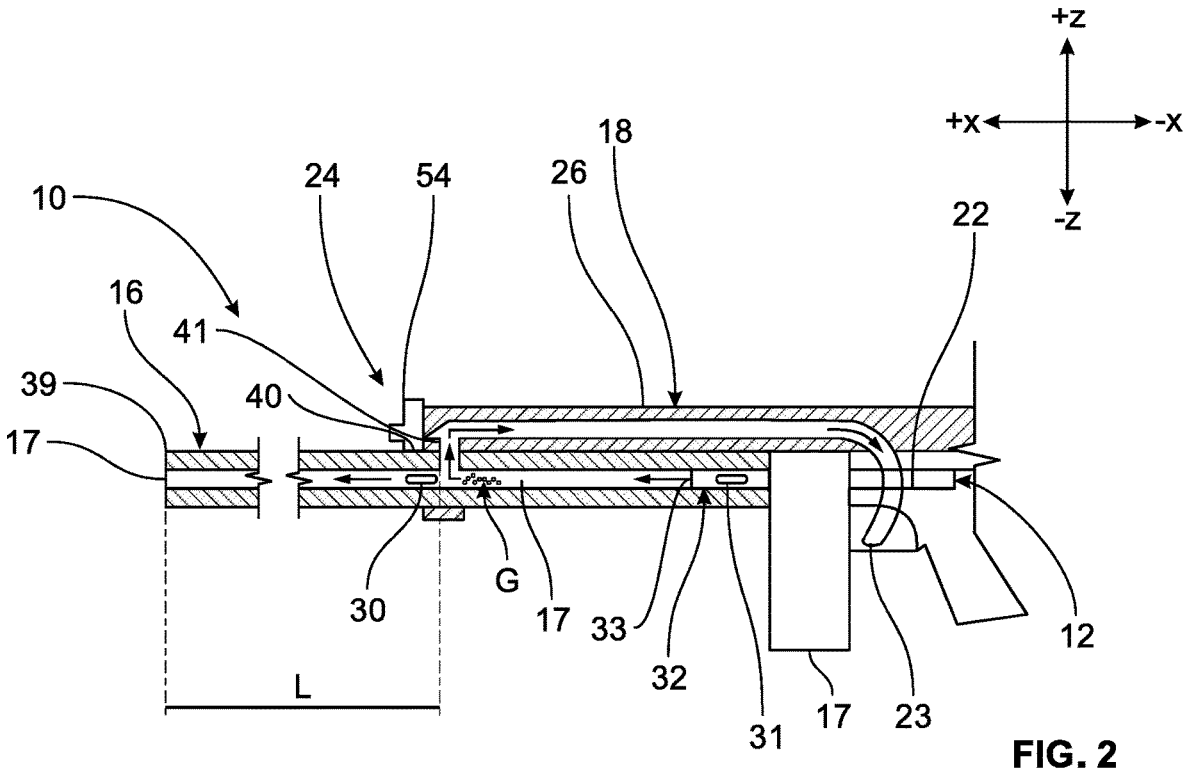
FIG. 2 is a magnified view of the area designated "A" in FIG. 1.

FIGS. 1 and 2 depict a gas-operated firearm 10. The firearm 10 is a semi-automatic rifle that fires one or more projectiles 30 in the form of bullets. The firearm 10 is a gas-operated firearm 10 equipped with a gas system 18 configured to capture energy generated by the firing of the projectiles 30, and to use the captured energy to cycle a mechanism that automatically reloads the firearm 10. Specific details of the firearm 10 are presented for exemplary purposes only. The inventive principles disclosed herein can be applied to other types of firearms, including but not limited to other types of rifles, including automatic rifles, shotguns, and pistols.

The firearm 10 comprises a receiver 12, a barrel 16, and a magazine 19 that holds unfired rounds of ammunition, or cartridges 32. The cartridges 32 each include a case 31. Each cartridge 32 also includes a projectile 30, a primer (not shown), and a propellant (also not shown) all housed within the case 31. The barrel 16 includes a chamber 33 that receives and houses an individual cartridge 32 immediately prior to firing, as shown in FIG. 2.

The receiver 12 comprises a trigger mechanism and an action 22. The trigger mechanism includes a trigger 23 that is pulled by the user, or shooter, in order to initiate the firing sequence of the firearm 10. Prior to firing, the trigger mechanism holds a hammer (not shown) in a cocked position. The trigger mechanism prevents the hammer from moving until the trigger 23 is pulled, and releases the hammer when the trigger 23 is pulled. Upon release, the hammer strikes a firing end of the cartridge 32 (or a firing pin), causing the primer within the cartridge 32 to ignite the propellant. Once ignited, the propellant forms a high-pressure propellant gas G that propels the projectile 30 through a lengthwise bore 17 formed in the barrel 16 until the projectile 30 exits the end or muzzle 39 of the barrel 16 at high velocity.

The action 22 ejects the spent case 31 from the firearm 10 after firing, and reloads an unfired, or pre-firing, cartridge 32 into the chamber 33 from the magazine 19. The action 22 is gas-actuated, i.e., the action 22 receives energy from the gas system 18 in the form of the high-pressure propellant gas G generated by the burning propellant of the cartridges 32, and uses that energy to eject the spent case 31 and to reload an unfired cartridge 32.

The gas system 18 is a direct-impingement gas system in which the propellant gas G acts directly on the action 22. Other types of gas systems, such as gas piston systems, can be used in the alternative. The action 22 is a bolt carrier group. Other types of actions can be used in the alternative.

Figure 3:
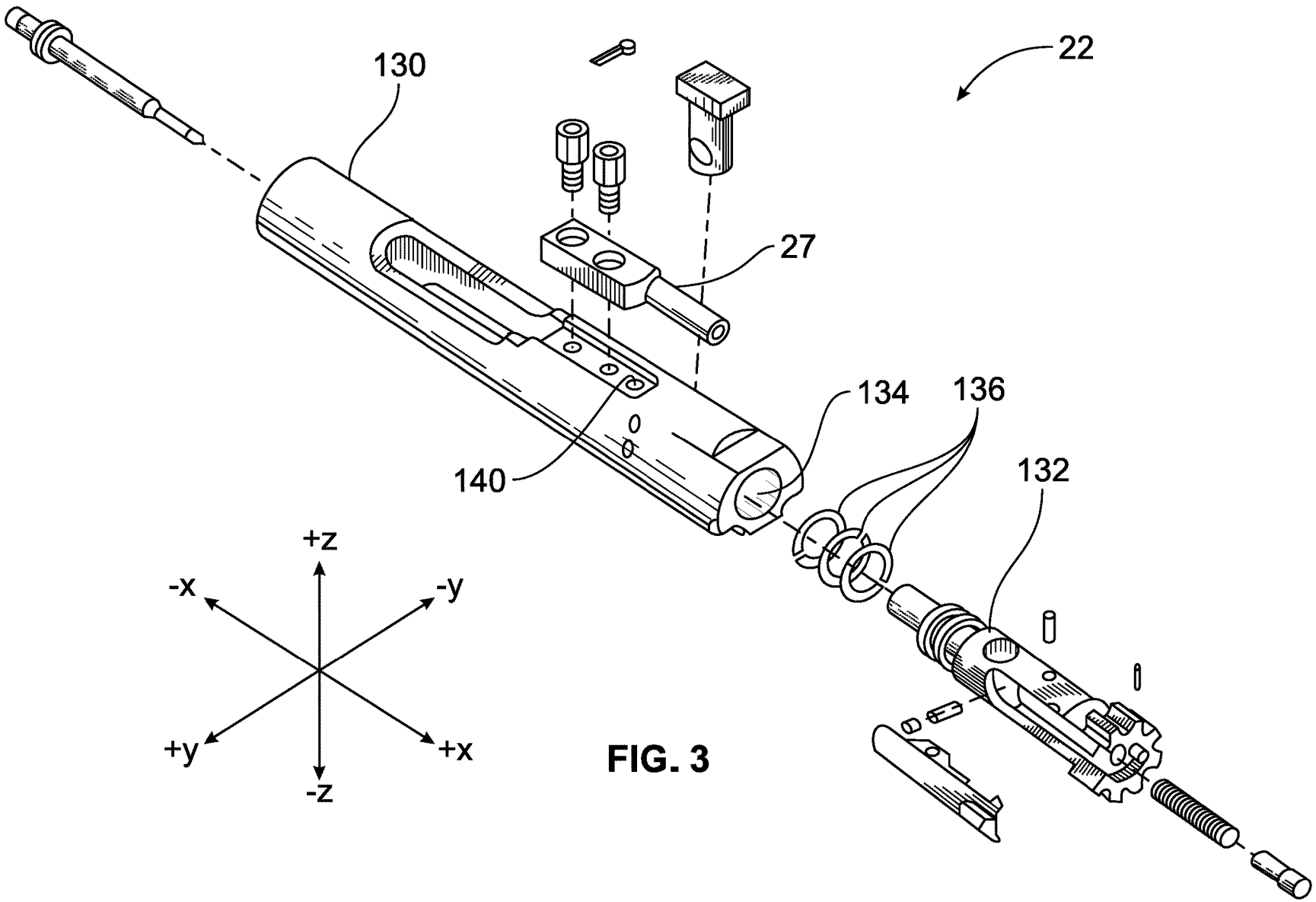
FIG. 3 is a partially exploded view of an action of the firearm shown in FIGS. 1 and 2.

The action 22 is shown in detail in FIG. 3. The action 22 includes a bolt carrier 130 and a bolt member 132. The bolt carrier 130 defines a bolt chamber 134. A rearward portion of the bolt member 132 is positioned within the bolt chamber 134, and can move both linearly and rotationally within the bolt chamber 134. The bolt member 132 has gas seal rings 136 that form a movable seal between the bolt member 132 and the adjacent surface of the bolt carrier 130 within the bolt chamber 134. A volume between an internal wall of the bolt carrier and the rear portion of the bolt member 132 forms a gas actuation chamber that receives the propellant gas G.

The bolt carrier 130 moves rearwardly, in a linear ("-x") direction, within the receiver 12 in response to the pressure exerted by the propellant gas G within the gas actuation chamber. In addition, the bolt member 132 is driven forwardly within the bolt chamber 134 by the pressure of the propellant gas G acting on the surface of the bolt carrier 132 and on the gas seal rings 136 of the bolt member 132. The bolt carrier 130 compresses a recoil spring (not shown) as the bolt carrier 132 translates rearwardly. The recoil spring drives the bolt carrier 130 and the bolt member 132 forwardly when the pressure exerted by the propellant gas G has decreased sufficiently so as to be overcome by the force of the recoil spring.

As the bolt carrier 130 is initially retracted rearward under the pressure of the propellant gas G, the bolt member 132 is rotated sufficiently to unlock its head portion from a locking receptacle (not shown). The bolt member 132 then retracts along with the bolt carrier 130. As the bolt member 132 is retracted, it extracts a spent cartridge case 31 from the chamber 33 of the barrel 16, and ejects the spent case 31 through a cartridge port, or breech 33, formed in the receiver 12. As the bolt carrier 130 and bolt member 132 subsequently are driven forward by the force of the recoil spring, the head portion of the bolt member strips an unfired cartridge 32 from the magazine 19, and feeds the cartridge 32 into the chamber 33 of the barrel 16 in preparation for subsequent firing.

Referring to FIGS. 4-12, the gas system 18 includes a gas block assembly 24, a gas tube 26, and a gas key 27. The gas block assembly 24 comprises a gas block 25 that receives propellant gas G from the barrel 16. The gas block 25 directs the propellant gas G to the gas tube 26, which in turn directs the high-pressure gas to the gas key 27. The gas key 27 is in fluid communication with a gas port 140 of the action 22.

The barrel 16 has a gas port 40 formed therein. The barrel gas port 40 extends through a wall of the barrel 16, as can be seen in FIGS. 1 and 2. The barrel gas port 40 is located forward of the chamber 33, i.e., to the left of the chamber 33 from the perspective of FIGS. 1 and 2, at a predetermined distance L from the muzzle 39 of the barrel 16. The barrel gas port 40 forms a passageway that extends in a direction approximately perpendicular to the lengthwise direction of the bore 17. The barrel gas port 40 can have other orientations in alternative embodiments.

Figures 4, 5:
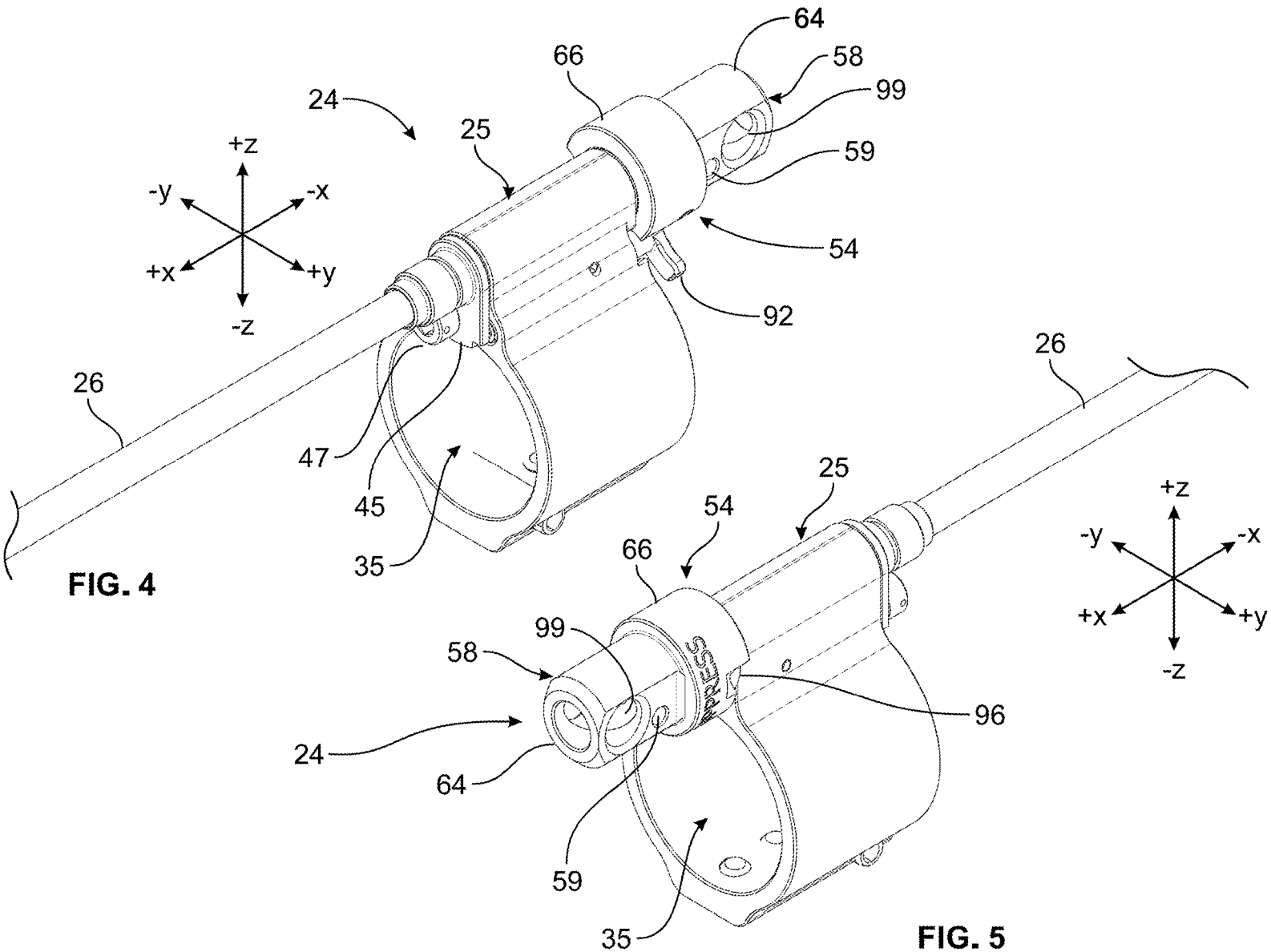
FIG. 4 is a top-rear perspective view of the gas block assembly of the firearm shown in FIGS. 1 and 2, with a flow restrictor device of the assembly in its unsuppressed position.
FIG. 5 is a top-front perspective view of the gas block assembly shown in FIG. 4, with the flow restrictor device in its unsuppressed position.

The gas block 25 includes a cylindrical barrel receiving passage 35 that receives the barrel 30, as shown for example in FIGS. 4 and 5. The gas block 25 can be secured to the barrel 25 by two set screws 36, shown in FIGS. 6 and 9. One or both of the set screws 36 can engage a corresponding dimple (not shown) formed in the barrel 16, to properly position the gas block 25 on the barrel 16.

The gas block 25 also has a gas port 41, and a gas tube receiving passage 42 formed therein. The gas block gas port 41 is visible in FIGS. 1, 2, 9, and 14A-14F. The gas tube receiving passage 42 is visible in FIGS. 14A-14F. The gas block gas port 41 adjoins the gas tube receiving passage 42, and forms part of a flow path between the bore 17 of the barrel 16, and the gas tube receiving passage 42. The gas block gas port 41 extends in a direction approximately perpendicular to the lengthwise or "x" direction of the barrel receiving passage 35, i.e., the gas block gas port 41 extends substantially in the "z" direction. The gas block gas port 41 can have other orientations in alternative embodiments. The gas port 41 can have a diameter of, for example, about 0.050 inch to about 0.130 inch, such as about 0.062 inch to about 0.094 inch. As used herein, the term "about" in reference to a numerical value means plus or minus 15 percent of the numerical value of the number with which it is being used.

The gas port 40 of the barrel 16 is aligned with the gas port 41 of the gas block 25 as shown in FIGS. 1 and 2, so that a portion of the propellant gas G in the bore 17 can enter the gas tube receiving passage 42 by way of the barrel gas port 40 and the gas block gas port 41. The diameter of the barrel receiving passage 35 is selected so that minimal clearance exists between the outer surface of the barrel 16 and the adjacent surface of the gas block 25, to discourage leakage of the propellant gas G as it flows between the barrel gas port 40 and the gas block gas port 41.

Figure 10:
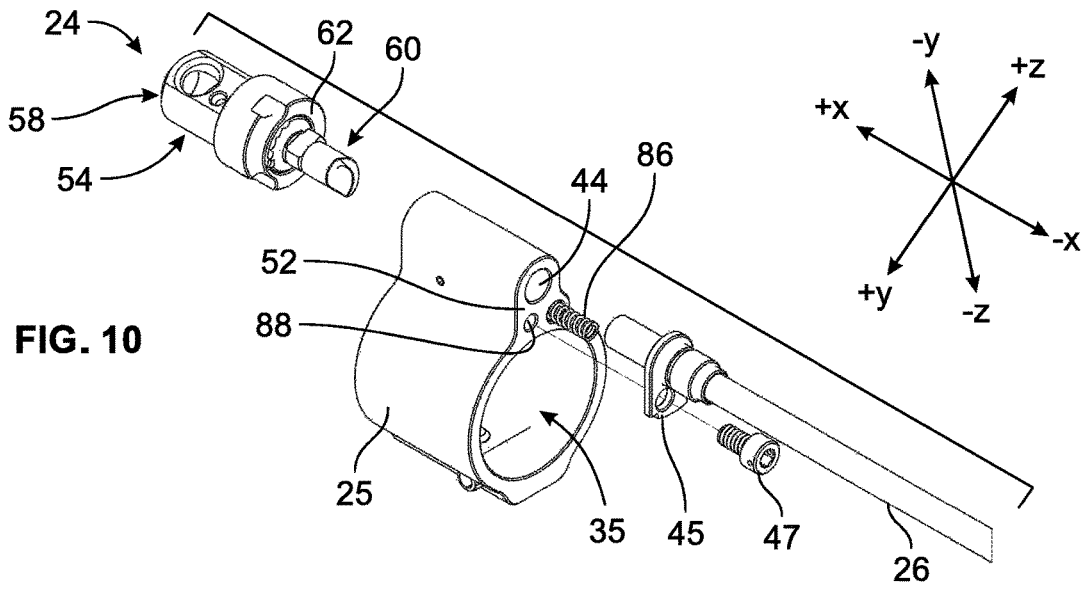
FIG. 10 is a partially exploded rear perspective view of the gas block assembly shown in FIGS. 4-9.

The gas tube receiving passage 42 extends in a direction substantially parallel to the lengthwise direction of the barrel receiving passage 35, i.e., the gas tube receiving passage 42 extends substantially in the "x" direction. The gas tube receiving passage 42 can have other orientations in alternative embodiments. A forward end of the gas tube receiving passage 42 is defined by a forward aperture 43 formed in a forward surface 51 of the gas block 25. The forward aperture 43 is substantially circular, with the exception of a notched or keyed area 53 visible in FIG. 6. A rearward end of the gas tube receiving passage 42 is defined by a rearward aperture 44 formed in a rearward surface 52 of the gas block 25, as shown in FIG. 10. The rearward aperture 44 is substantially circular.

The gas tube receiving passage 42 receives a forward end of the gas tube 26 by way of the rearward aperture 44. The diameter of the forward end of the gas tube 26 is selected so that minimal clearance exists between the forward end of the gas tube 26 and the adjacent surface of the gas block 25, to discourage leakage of the propellant gas G as it flows between the gas tube receiving passage 42 and the gas tube 26. The gas tube 26 is secured to the gas block 25 by a flange 45 and a screw 47, as shown for example in FIGS. 4 and 6. The gas tube 26 can be secured to the gas block 25 by other means, such as an interference fit or a pin, in alterative embodiments. The rearward end of the gas tube 26 is positioned within the gas key 27, and provides a path for discharging the propellant gas G into the gas key 27.

The propellant gas G generated by the burning propellant of the cartridge 32 travels behind, and propels the projectile 30 through the bore 17 of the barrel 16, as indicated by the arrows in FIG. 2. As the propellant gas G reaches the barrel gas port 40, a portion of the propellant gas G enters, and travels through the barrel gas port 40. The propellant gas G then enters the gas block gas port 41, which directs the propellant gas G to the gas tube receiving passage 42. The propellant gas G reaches the gas tube 26 by way of the gas tube receiving passage 42, and then travels through the gas tube 26 and towards the action 22. The propellant gas G subsequently is released into the gas actuation chamber of the action 22 by way of the gas key 27 and the gas port 140. The barrel gas port 40, gas block gas port 41, gas tube receiving passage 42, gas tube 26, and gas key 27 thus form a continuous flow path between the bore 17 of the barrel 16, and the action 22.

Some Features that Facilitate Restricted and Unrestricted Propellant Gas Flow

Referring to FIGS. 4-13, the gas block assembly 24 also comprises a flow restrictor device 54 that is configured to allow the user to adjust the volume and pressure of the propellant gas G that reaches the action 22. This feature can be used, for example, when the firearm 10 is used with a suppressor. Because the suppressor restricts the flow of the propellant gas G exiting the barrel 17, the presence of the suppressor causes the pressure of the propellant gas G in the barrel 17 to be higher than it otherwise would be, which in turn results in a higher pressure and flow rate of the propellant gas G reaching the action 22 by way of the gas system 18. The increased pressure and flow rate can exceed the pressure and flow rate at which the action 22 is designed to operate, increasing the potential for premature wear and damage to the action 22, and jamming of the firearm 10. The flow restrictor device 54 permits the user to restrict the flow of propellant gas G reaching the action 22 by way of the gas system 18, thereby allowing the action 22 to function within, or close to its design parameters when the firearm 10 is used with a suppressor. This feature also can be used, for example, when the firearm 10 is used with a type of cartridge 32 that generates propellant gas G at a relatively high pressure.

The flow restrictor device 54 comprises a flow restrictor 56 and a flow restrictor housing 58. The flow restrictor device 54 is mounted for rotation on the gas block 25. The flow restrictor 56 comprises a first, or restricting portion 60; a second, or retaining portion 62 that adjoins a forward end of the first portion 60; and a third, or indexing portion 63 that adjoins a forward end of the retaining portion 62. The flow restrictor housing 58 has a forward, or first portion 64; and a rearward, or second portion 66.

Figure 11:
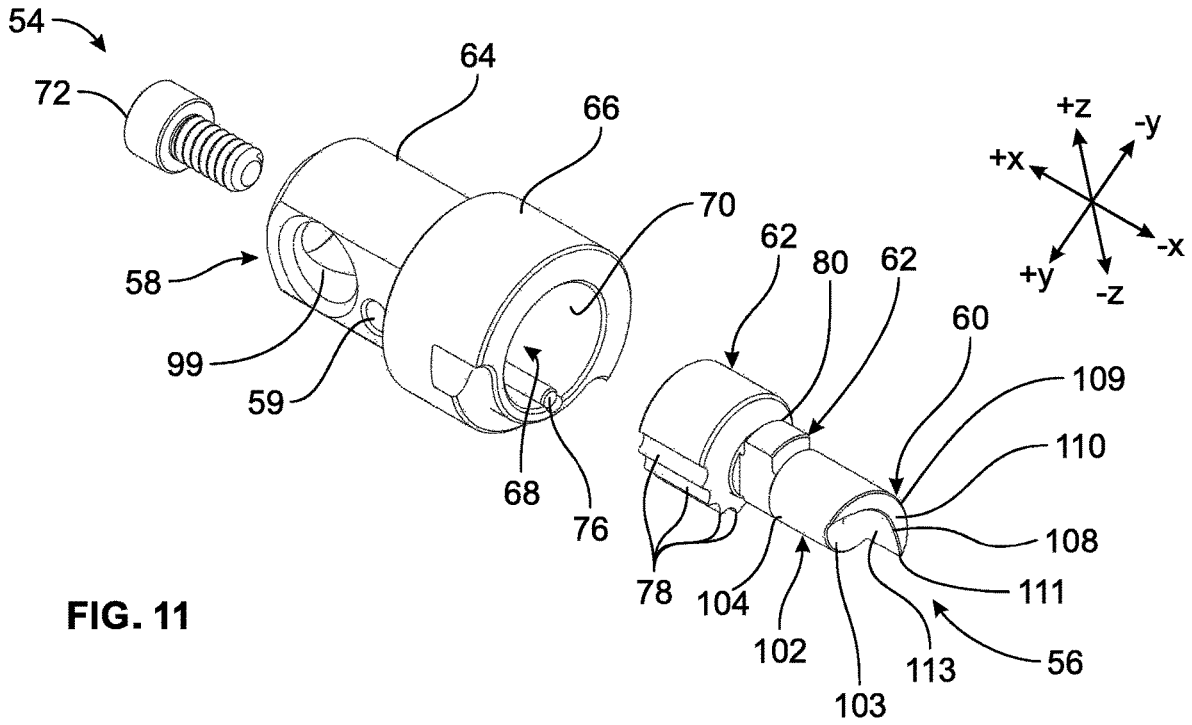
FIG. 11 is a rear perspective exploded view of the flow restrictor device of the gas block assembly shown in FIGS. 4-10.

The indexing portion 63 of the flow restrictor 54 is positioned within a cylindrical cavity 68 formed in the second portion 66 of the flow restrictor housing 58, as can be seen in FIGS. 10 and 11. The cavity 68 is defined by an interior wall surface 70 of the second portion 66. The flow restrictor 56 is secured to the flow restrictor housing 58 by a screw 72 that extends through the first portion 64 of the flow restrictor housing 58 and engages internal threads formed in the indexing portion 63 of the flow restrictor 56. The flow restrictor housing 58 has holes 59 formed therein to accommodate an optional roll pin (not shown) or other mechanical means that can prevent the screw 72 from backing out, and/or discourage tampering with the screw 72.

The flow restrictor device 54 can have an overall length of about 1.0 inch to about 1.5 inches. The flow restrictor housing 58 can have a length of about 0.75 inch to about 1.25 inches. The cavity 68 can have a diameter of about 0.35 inch to about 0.45 inch. Specific dimensions for the flow restrictor device 54 are presented herein for exemplary purposes only, and unless expressly stated otherwise are not intended to limit the scope of the appended claims; alternative embodiments of the flow restrictor device 54 can have dimensions other than those specified herein.

Figure 6:
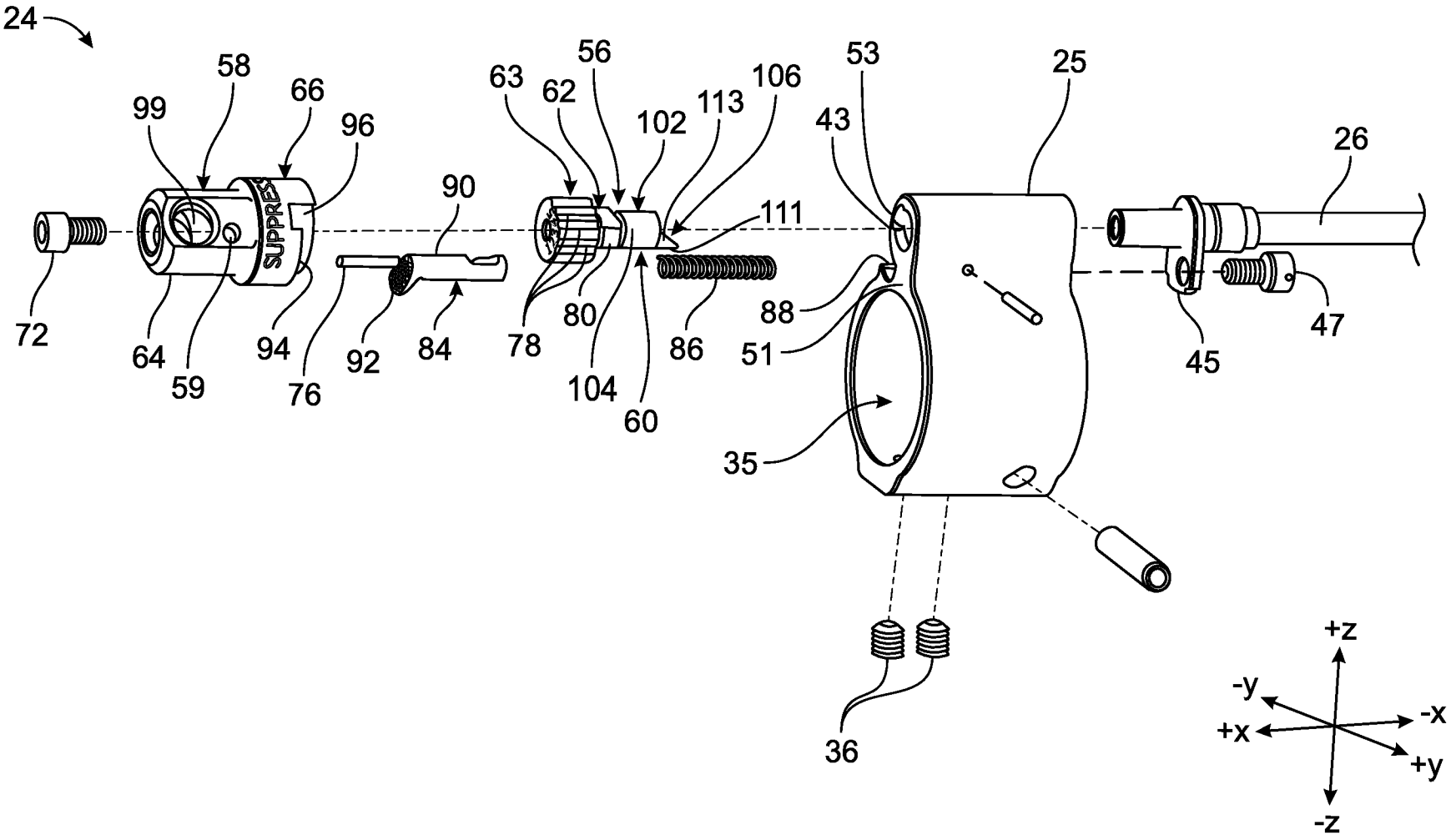
FIG. 6 is an exploded front perspective view of the gas block assembly shown in FIGS. 4 and 5.
Figure 7:
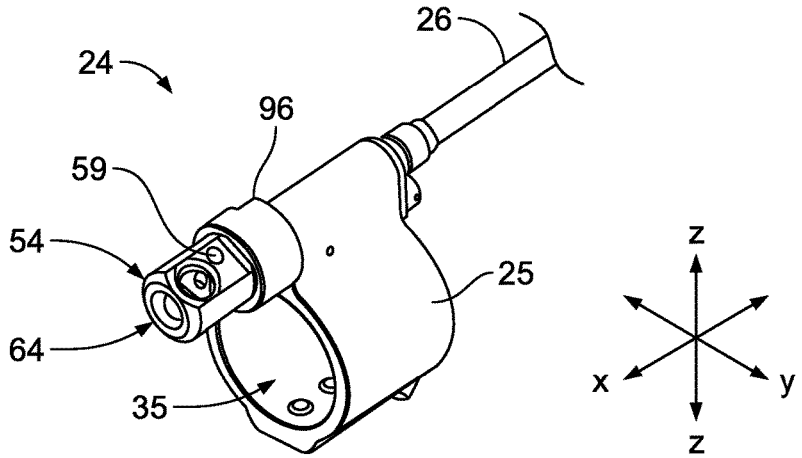
FIG. 7 is a top-front perspective view of the gas block assembly shown in FIGS. 4-6, with the flow restrictor device in its suppressed position.
Figure 8:
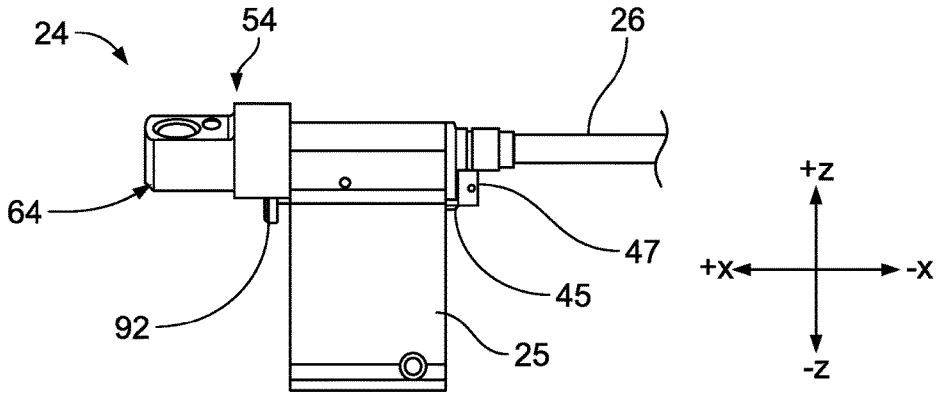
FIG. 8 is a side view of the gas block assembly shown in FIGS. 4-7, with the flow restrictor device in its suppressed position.
Figure 9:
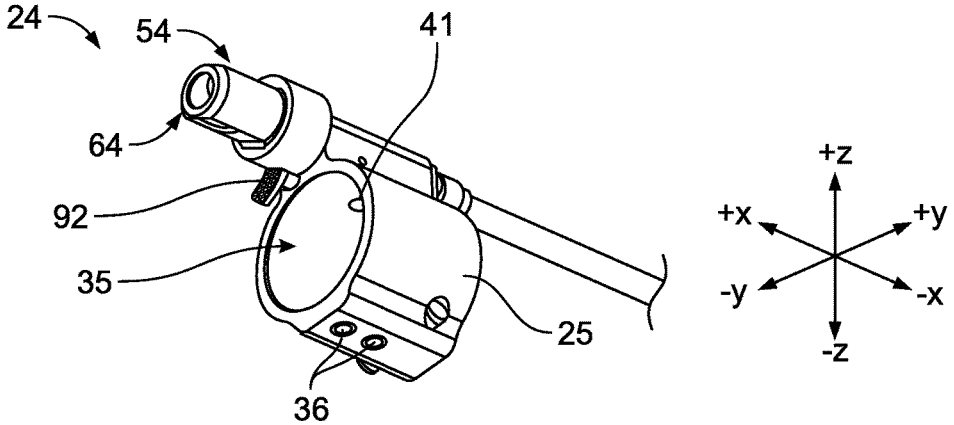
FIG. 9 is a bottom-front perspective view of the gas block assembly shown in FIGS. 4-8, with the flow restrictor device in its suppressed position.
Figure 12:
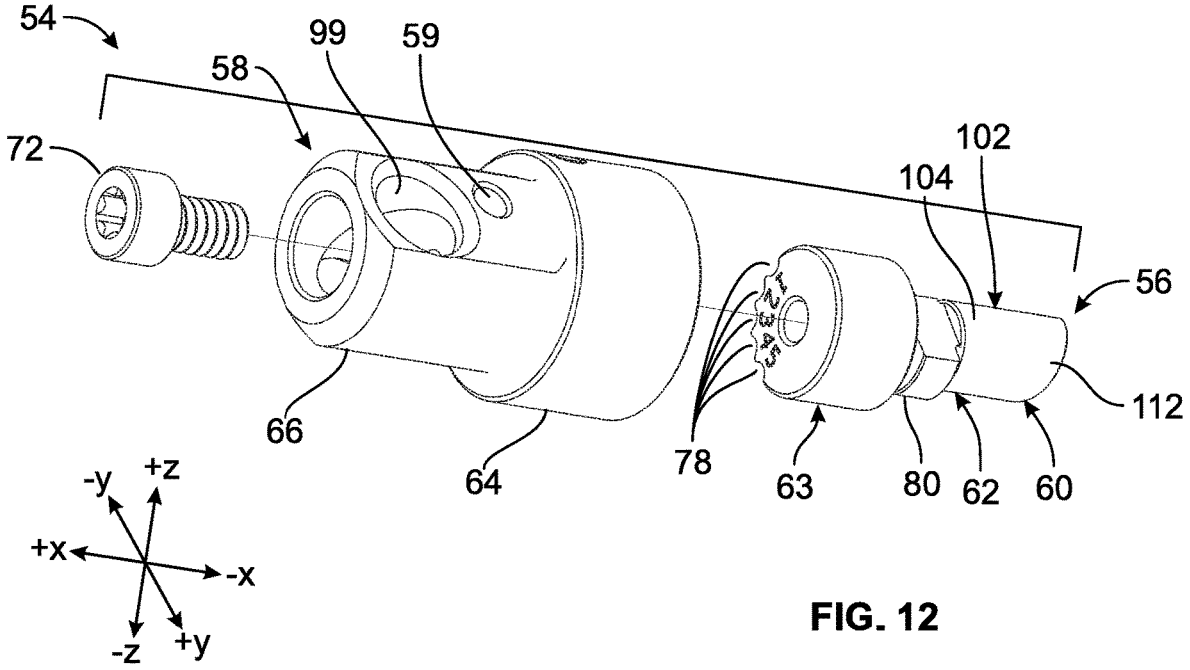
FIG. 12 is a front perspective exploded view of the flow restrictor device shown in FIG. 11.
Figure 13:
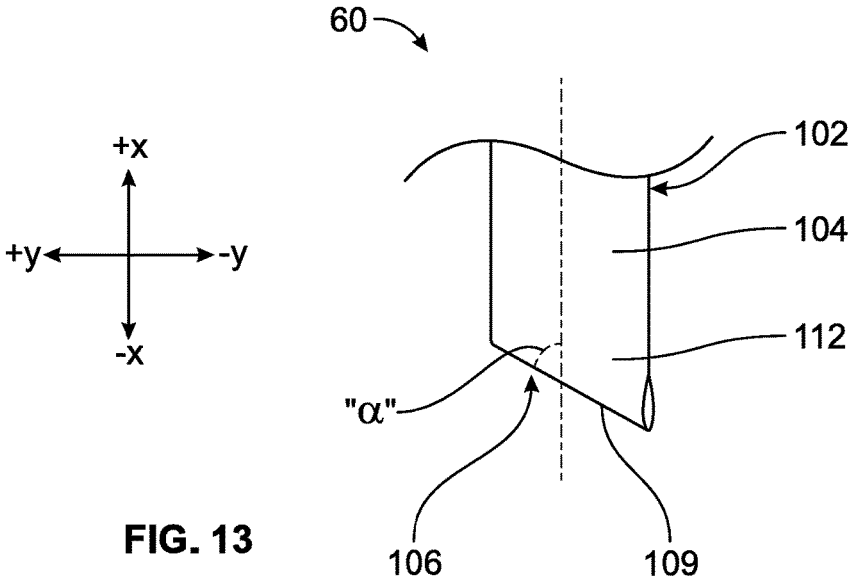
FIG. 13 is a top view of a restricting portion of the flow restrictor device shown in FIGS. 11 and 12.

The flow restrictor housing 58 includes an indexing key in the form of an indexing pin 76. The indexing pin 76 is disposed in a groove formed in the wall surface 70 of the flow restrictor housing 58, and extends in the lengthwise, or "x" direction of the flow restrictor housing 58, as shown in FIG. 11. The indexing portion 63 of the flow restrictor 56 has five notches or grooves 78 formed therein and extending in the lengthwise direction of the flow restrictor 56, as can be seen in FIGS. 6, 11, and 12. Each groove 78 is configured to receive the indexing pin 76 of the flow restrictor housing 58 when the flow restrictor 56 is at a particular angular, or clock position in relation to the flow restrictor housing 58.

The grooves 78 and the indexing pin 76, along with the screw 72, cause the flow restrictor 56 to rotate with the flow restrictor housing 58. In addition, the grooves 78 and the indexing pin 76 permit the flow restrictor 56 to be indexed in five different angular positions in relation to the flow restrictor housing 58. The significance of this feature is discussed below.

The grooves 78 can be formed in the flow restrictor housing 58, and the indexing pin 76 can be positioned on the flow restrictor 56 in alternative embodiments. Also, other types of indexing keys, such as a tab, can be used in lieu of the indexing pin 76. Moreover, alternative embodiments can include less, or more than five grooves 78 (e.g., 2, 3, 4, 6, 7, 8, or 9 grooves), depending on the desired degree of adjustability in the position of the flow restrictor 56 in relation to the flow restrictor housing 58.

The flow restrictor device 54 is mounted for rotation on the gas block 25. The first, or restricting portion 60, and the second, or retaining portion 62 of the flow restrictor 56 are located within the gas tube receiving passage 42 when the flow restrictor device 54 is mounted on the gas block 25. The flow restrictor device 54 is retained on the gas block 25 by interference between the retaining portion 62 and the gas block 25. In particular, the retaining portion 62 has a keyed area 80 that locally increases the diameter of the retaining portion 62, as can be seen in FIGS. 6, 11, and 12. The forward aperture 43, and the adjoining portion of the gas tube receiving passage 42 in the gas block 25, have a shape that matches that of the retaining portion 62. In particular, the forward aperture 43 has a notched area 53, as noted above; and the notched area 53 extends slightly into the gas tube receiving passage 42. The notched area 53 locally increases the diameters of the forward aperture 43 and the gas tube receiving passage 42, as shown in FIG. 6.

The retaining portion 62 of the flow restrictor 56 can only pass through the aperture 43 and the forward portion of the gas tube receiving passage 42 when the keyed area 80 of the retaining portion 62 is aligned with the notched area 53. The flow restrictor device 54 is installed on the gas block 25 by aligning the keyed area 80 on the retaining portion 62 with the notched area 53. The restricting portion 60 and the retaining portion 62 are then inserted through the forward aperture 53 and into the gas tube receiving passage 42, until the indexing portion 63 of the flow restrictor 56, which has a larger overall diameter than the aperture 53, abuts the forward surface 51 of the gas block 25.

At this point, the retaining portion 62 aligns with a groove 81 within the gas tube receiving passage 42. The groove is visible in FIGS. 14A-14F. The groove 81 is configured to receive the keyed area 80 on the retaining portion 62. The flow restrictor 56 can be rotated as this point so that the keyed area 80 enters the groove 81. Interference between the forward surface of the groove 81 and the keyed area 80 will prevent the retaining portion 62 from backing out of the gas tube receiving passage 42 while the keyed area 80 and the notched area 53 remained misaligned, thereby causing the flow restrictor 56 to be retained on the flow restrictor housing 58. The retaining portion 62 can have a length of about 0.09 inch to about 0.12 inch, and a maximum diameter of about 0.25 inch to about 0.375 inch.

The flow restrictor device 54 also comprises a plunger, or stop 84, and a biasing means (e.g., spring 86), as shown in FIG. 6. The spring 86 is located in a spring passage 88 that extends between the forward surface 51 and the rearward surface 52 of the gas block 25. The rearward end of the spring passage 88 is covered by the flange 45 of the gas tube 26 as depicted in FIG. 4, so that the flange 45 retains the spring 86.

The stop 84 includes an elongated portion 90, and a tab 92. The elongated portion 90 is positioned within the spring passage 88, and compresses the spring 86 so that the spring 86 exerts a spring force, or bias, on the stop 84 in the forward direction. The tab 92 abuts the rearward portion 66 of the flow restrictor housing 58; the flow restrictor housing 58 thereby retains the stop 84 in the spring passage 88.

The rearward portion 66 of the flow restrictor housing 58 has a recess 94 formed therein and extending along a portion of the outer periphery of the rearward portion 66. Two detents 96 are also formed in the rearward portion 66, at opposite ends of the recess 94, as can be seen in FIGS. 5, 6, and 11.

The recess 94 and the detents 96 accommodate the stop 84. The stop 84, in conjunction with the detents 96, limit the rotational movement of the flow restrictor device 54 between a first, or unsuppressed portion; and a second, or suppressed position. When the flow restrictor device 54 is located in the suppressed position, as shown for example in FIGS. 7-9, the flow restrictor 56 partially blocks the gas block gas port 41. This feature can be used, for example, to compensate for the increased pressure of the propellant gas G within the barrel 16 when the firearm 10 is fired with a suppressor installed. When the flow restrictor device 54 is located in the unsuppressed position, as shown for example in FIGS. 4 and 5, the flow restrictor 56 does not block the gas block gas port 41, allowing the propellant gas G to pass through the gas block gas port 41 and into the gas tube 26 in an unrestricted manner.

A first of the detents 96 aligns with the tab 92 of the stop 84 when the flow restrictor device 54 is in the suppressed position. The other, or second detent 96 aligns with the tab 92 when the flow restrictor device 54 is in the unsuppressed position. The forward bias of the spring 86 urges a portion of the tab 92 into the first or second detent 96 when the tab 92 is aligned with that particular detent 96. Interference between the tab 92, which his mounted on the gas block 25, and the adjacent surfaces of the flow restrictor housing 58 inhibits rotation of the flow restrictor device 54 in relation to the gas block 25 when the tab 92 is positioned within either of the detents 96. This can be seen, for example, in FIG. 8, which depicts the tab 92 biased into its forward position within one of the detents 96. The tab 92 will remain in the detent 96 until the user pushes, or depresses the tab 92 rearward, against the bias of the spring 86.

When the tab 92 is fully depressed in the detent 96, the flow restrictor device 54 can be rotated in a direction that moves the other, unoccupied detent 96 toward the tab 92. The recess 94 in the flow restrictor housing 58 accommodates the tab 92, in its depressed state, as the flow restrictor device 54 is rotated, so that the depressed tab 92 does not interfere with the rotation of the flow restrictor device 54. The tab 92 will align with the previously unoccupied detent 96 as the flow restrictor device 54 reaches its suppressed or unsuppressed position, depending on the direction in which the flow restrictor device 54 is being rotated. The tab 92, upon aligning with the detent 96, is urged forwardly, into the detent 96, under the bias of the spring 86. The tab 92 will retain the detent 96, and the flow restrictor device 54 will remain in its suppressed or unsuppressed position, until the tab 92 is once again depressed by the user.

The first, or forward portion of the flow restrictor housing 58 can be used as a knob to facilitate manual rotation the flow restrictor device 54. If necessary or otherwise desired, a cartridge case or similarly shaped object can be inserted through openings 99 formed in the sides of the forward portion, and used to rotate the flow restrictor device 54.

Details of the stop 84, the recess 94, and the detents 96 are provided for exemplary purposes only. Other means for retaining the flow restrictor device 54 in the suppressed and unsuppressed positions can be used in the alternative.

The first, or restricting portion 60 of the flow restrictor 56 restricts the flow of propellant gas G through the gas block gas port 41 when the flow restrictor device 54 is in its suppressed position. Referring to FIGS. 6 and 11-13, the restricting portion 60 comprises a substantially cylindrical body 102 that adjoins the retaining portion 62 of the flow restrictor 56. The body 102 has a substantially planar rearward surface 103. The rearward surface 103 is oriented substantially in the lateral or "y" direction. The body 102 also has an outer surface 104.

The restricting portion 60 also comprises a tail portion 106 that adjoins the body 102. The tail portion 106 has a relatively thin and wide, i.e., blade-like, overall profile. The tail portion 106 has an inner edge 108, an outer edge 109, and a rearward surface 110. The rearward surface 110 is positioned between, and is defined by the inner edge 108 and the outer edge 109. A first end of the outer edge 109 adjoins a first end of the inner edge 108; a second end of the outer edge 109 adjoins a second end of the inner edge 108. These features, in conjunction with the curvilinear shape of the inner edge 108 and outer edge 109, give the rearward surface 110 a shape approximating that of a crescent. The tail portion 106 also includes a third edge 111 that extends substantially in the lengthwise or "x" direction, and adjoins the rearward surface 103 of the body 102.

The tail portion 106 further comprises an outer surface 112 that adjoins the outer surface 104 of the body 102, and is defined in part by the outer edge 109 and the third edge 111. The outer surface 112 and the outer surface 104 both have a curvature that substantially matches that of the adjacent surface of the gas tube receiving passage 42. The body 102 and the tail portion 106 are configured so that minimal clearance exists between the outer surfaces 112, 104 and the adjacent surface of the gas tube receiving passage 42.

The tail portion 106 also comprises an inner surface 113. The inner surface 113 adjoins the rearward surface 103 of the body 102, and is defined part by the inner edge 108 and the third edge 111. The inner surface 113 has a curvature that substantially matches that of the inner edge 108.

The outer edge 109 of the tail portion 106 is angled in relation to the lengthwise, or "x" direction of the flow restrictor 56. The angle between the outer edge 109 and the x direction is denoted in FIG. 13 by the symbol "a." The angle $\alpha$ is an acute angle, i.e., an angle less than 90 degrees. In the exemplary embodiment, the angle $\alpha$ is about 40 to about 80 degrees, and preferably about 70 degrees. The angle $\alpha$ can have other values in alternative embodiments, depending of factors such as the desired degree of restriction of the gas block gas port 41, whether and to what extent the flow restrictor 56 can be indexed in different positions in relation to the flow restrictor housing 58. The angled orientation of the outer edge 109 causes the shape of the tail portion 106 to appropriate that of a helix.

The body 102 can have a diameter of about 0.19 inch to about 0.25 inch, and a length of about 0.2 inch to about 0.3 inch. The tail portion 106 can have a maximum length of about 0.09 inch to about 0.16 inch.

The flow restrictor 56 is configured so that the outer surface 112 of the tail portion 106 partially covers, or blocks the gas block gas port 41 when the flow restrictor device 54 is in its suppressed position, thereby reducing the flow rate and pressure of the propellant gas G entering the gas tube receiving passage 42 and the gas tube 26.

The flow restrictor 56 is further configured so that the tail portion 106 does not block the gas block gas port 41 when the flow restrictor device 54 is in its unsuppressed position. In particular, when the flow restrictor 56 is in its unsuppressed position, the outer surface 112 of the tail portion 106 is no longer partially aligned with the gas block gas port 41, and the flow of the propellant gas G through the gas block gas port 41 is unrestricted. This can be seen in FIG. 14A, which depicts the flow restrictor device 54 in its unsuppressed position.

Some Features that Facilitate Adjustment of the Propellant Gas Flow

Figure 14A:
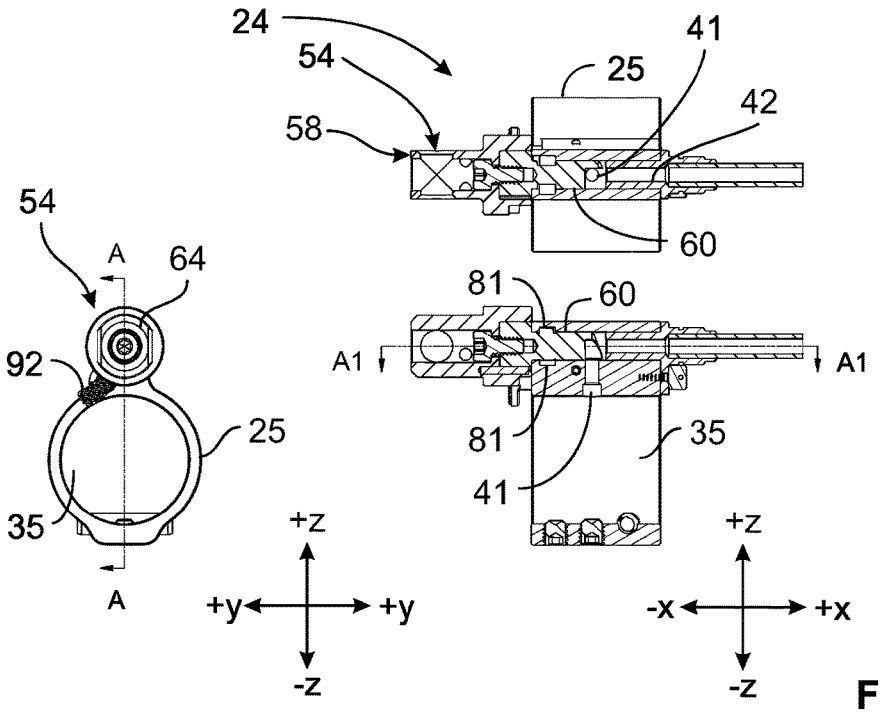
FIG. 14A includes a front view, and cross-sectional views taken through lines "A" and "A1," of the gas block assembly shown in FIGS. 4-13, with the flow restrictor device in its unsuppressed position.
Figure 14B:
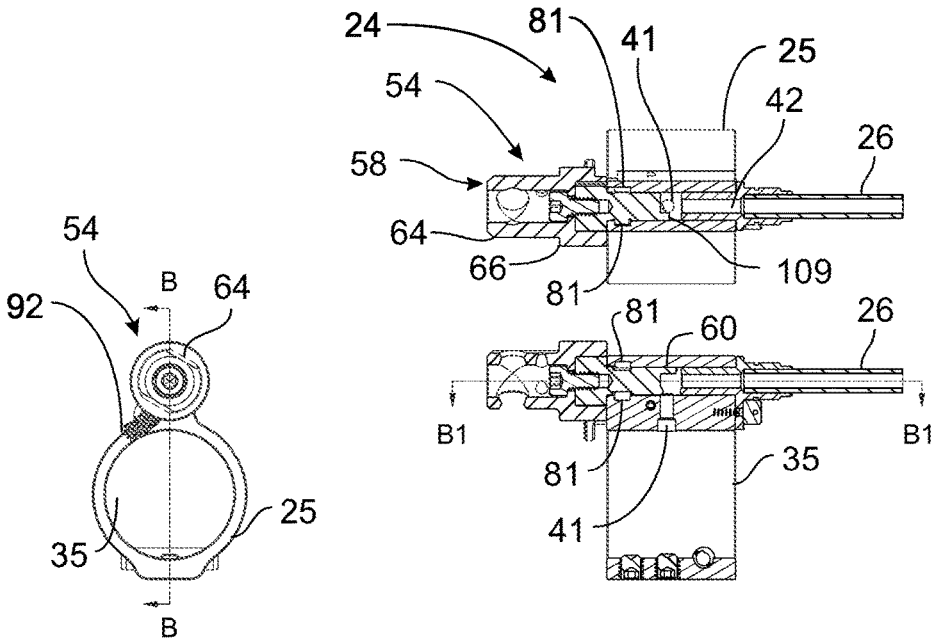
FIG. 14B includes a front view, and cross-sectional views taken through lines "B" and "B1," of the gas block assembly shown in FIGS. 4-14A, with the flow restrictor device in its suppressed position, and with an indexing portion of the flow restrictor device in a first indexed position in relation to a housing of the flow restrictor device.

In addition, the angled orientation of the outer edge 109 of the tail portion 106, in conjunction with the indexing pin 76 of the flow restrictor housing 58 and the grooves 78 formed in the flow restrictor 56, permit the degree of blockage of the gas block gas port 41 to be varied as follows. The flow restrictor 56 can be positioned within the flow restrictor housing 58 in five different angular orientations, or clock positions, depending on which groove 78 is aligned with the indexing pin 76 as the flow restrictor 56 is inserted into the flow restrictor housing 58. When the indexing pin 76 is aligned with a first of the grooves 78 and the flow restrictor device 54 is in the suppressed position, the orientation of the flow restrictor 56 is such that the outer surface 112 of the tail portion 106 covers a relatively small percentage of the overall area of the gas block gas port 41, as shown in FIG. 14B. Thus, the flow restrictor 56 will present a minimal restriction to the flow of propellant gas G through the gas block gas port 41 under these circumstances.

Figure 14C:
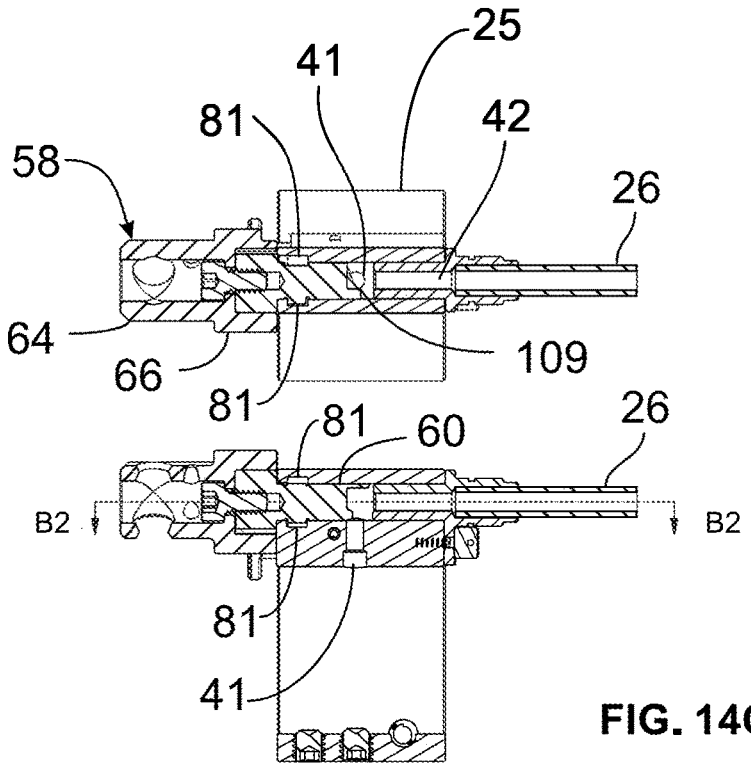
FIG. 14C includes cross-sectional views, taken through line "B" of FIG. 14B, and line "B2," of the gas block assembly shown in FIGS. 4-14B, with the flow restrictor device in its suppressed position, and with the indexing portion in a second indexed position in relation to the housing.

When the indexing pin 76 is aligned with a second of the grooves 78, instead of the first groove 78, and the flow restrictor device 54 is in the suppressed position, the resulting change in the angular position of the tail portion 106, in conjunction with the angled orientation of the outer edge 109 of the tail portion 106, causes more of the outer surface 112 of the tail portion 106 to cover the gas block gas port 41 as shown in FIG. 14C. In particular, with the indexing pin 76 aligned with the second instead of the first groove 78, the same angular displacement of the flow restrictor device 54 between the unsuppressed and suppressed positions causes a different portion of the outer surface 112 to rotate into a position over the gas block gas port 41; and due to the angled orientation of the outer edge 109 (which defines the rearward boundary of the outer surface 112), the different portion of the outer surface 112 covers more of the gas block gas port 41. Thus, the degree of restriction in the flow through the gas block gas port 41 is increased when the indexing pin 76 is aligned with the second, instead of the first groove 78.

The degree of restriction in the flow through the gas block gas port 41 can be further increased by aligning the indexing pin 76 with the third, fourth, and fifth grooves 78. As explained above, aligning the indexing pin 76 with a different groove 78 causes a different portion of the outer surface 112 of the tail portion 106 to cover the gas block gas port 41 when the flow restrictor device 54 reaches the suppressed position, and the angled orientation of the outer edge 109 of the tail portion 106 results in more, or less of the outer surface 112 being positioned over the gas block gas port 41.

Figure 14D:
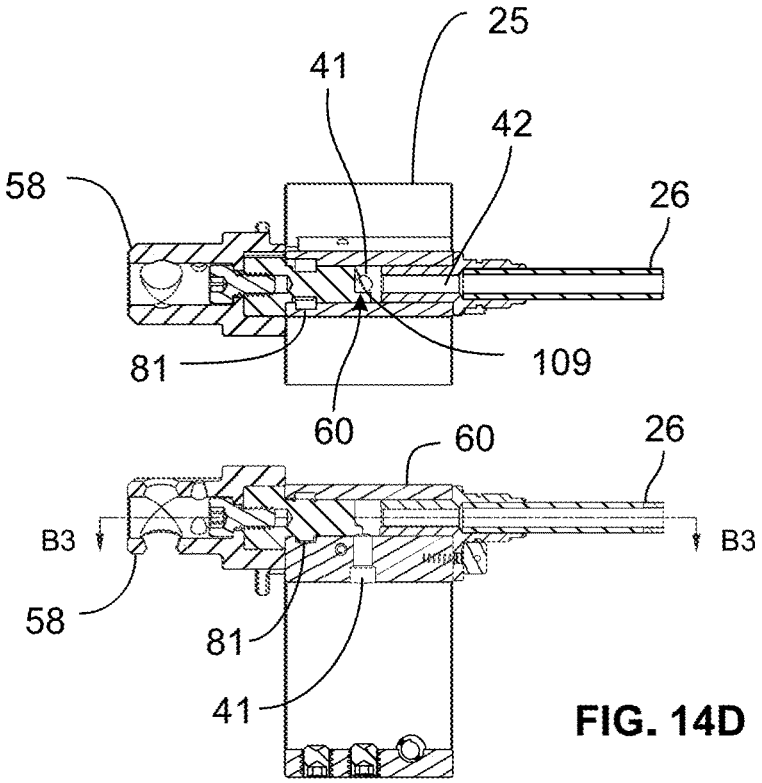
FIG. 14D includes cross-sectional views, taken through line "B" of FIG. 14B, and line "B3," of the gas block assembly shown in FIGS. 4-14C, with the flow restrictor device in its suppressed position, and with the indexing portion in a third indexed position in relation to the housing.
Figure 14E:
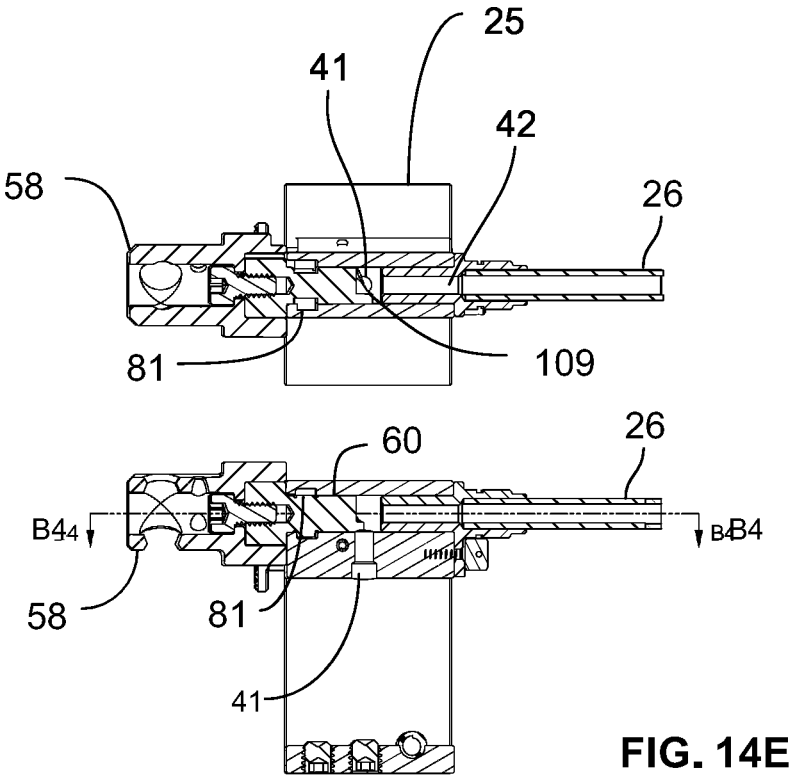
FIG. 14E includes cross-sectional views, taken through line "B" of FIG. 14B, and line "B4," of the gas block assembly shown in FIGS. 4-14C, with the flow restrictor device in its suppressed position, and with the indexing portion in a fourth indexed position in relation to the housing.
Figure 14F:
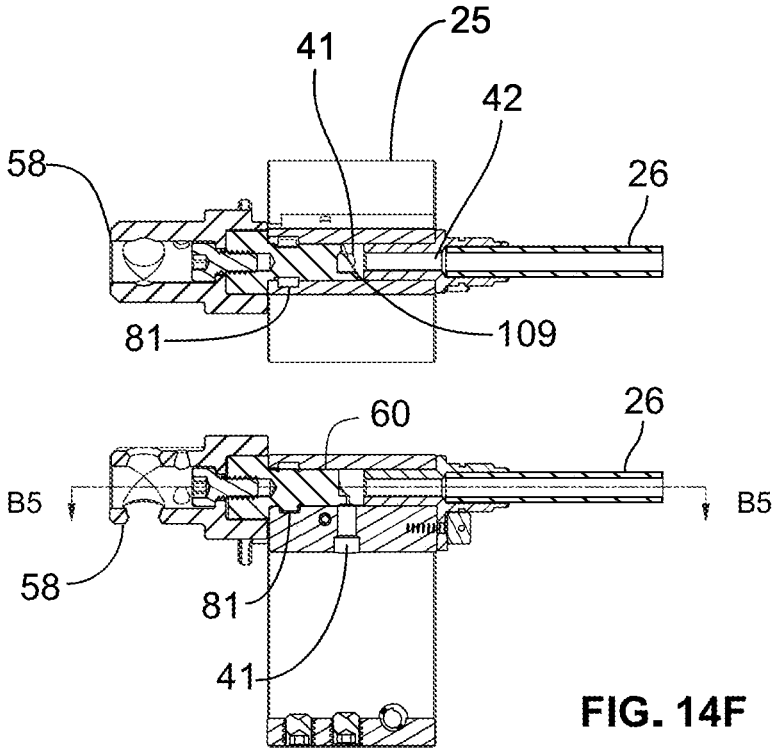
FIG. 14F includes cross-sectional views, taken through line "B" of FIG. 14B, and line "B5," of the gas block assembly shown in FIGS. 4-14D, with the flow restrictor device in its suppressed position, and with the indexing portion in a fifth indexed position in relation to the housing.

This can be seen, for example, in FIG. 14D, which depicts the flow restrictor device 54 when the indexing pin 76 is aligned with the third groove 78; in FIG. 14E, which depicts the flow restrictor device 54 when the indexing pin 76 is aligned with the fourth groove 78; and in FIG. 14F, which depict the flow restrictor device 54 when the indexing pin 76 is aligned with the fifth groove 78. As can be seen by comparing FIGS. 14B and 14C, the amount of blockage of the gas block gas port 41 increases as the indexing pin 78 is aligned with the second, as opposed to the first, groove 78. Further blockage occurs as the indexing pin 76 is aligned successively with the third, fourth, and fifth grooves 78 as shown in FIGS. 14D-14F; with maximal blockage being achieved when the indexing pin 76 is aligned with the fifth groove 78.

Each groove 78 can be angularly spaced from its adjacent groove 78 or grooves 78 by, for example, about 24 degrees. Thus, moving the flow restrictor 56 from a state where, for example, the first groove 78 is aligned with the indexing pin 76 and into a state where the second groove 78 is aligned with the indexing pin 76 will result in an angular displacement of the flow restrictor 56 of about 24 degrees. Also, the percentage of the area of the gas block gas port 41 that remains open, i.e., that is not covered or blocked by the tail portion 106 of the flow restrictor 56, when the first, second, third, fourth, and fifth grooves 78 are aligned with the indexing pin 76, and the flow restrictor device 54 is in its unsuppressed position, is about 87% to about 91% (e.g., about 89%), about 73% to about 77% (e.g., about 75%), about 58% to about 62% (e.g., about 60%), about 42% to about 46% (e.g., about 44%), and about 27% to about 31% (e.g., about 29%), respectively. As noted above, the tail portion 106 of the flow restrictor 56 does not over any portion of the gas block gas port 41 when the flow restrictor device 54 is in its unsuppressed position, regardless of the alignment between the grooves 78 and the indexing pin 76.

Thus, the flow restrictor device 54 is switchable between a suppressed and unsuppressed position. In addition, the flow restrictor device 54 is adjustable to permit variation in the degree to which the flow rate and pressure of the propellant gas G are attenuated when the flow restrictor device 54 is in the suppressed position. As noted above, when the firearm 10 is to be used without a suppressor, the flow restrictor device 54 can be placed in the unsuppressed position, so that the flow restrictor device 54 provides no restriction on the propellant gas G entering the gas tube receiving passage 42 by way of the gas block gas port 41.

When the firearm 10 is to be used with a suppressor, the user merely needs rotate the flow restrictor device 54 to the suppressed position. The resulting reduction in the flow rate and pressure of the propellant gas G entering the gas tube receiving passage 42 compensates for the increased gas pressure within the barrel 16 resulting from the back-pressure introduced by the suppressor. By attenuating the flow rate and pressure of the propellant gas G reaching the action 22, the flow restrictor device 54 can prevent premature wear and damage to the action 22, and jamming of the firearm 10, that otherwise could occur due to exposure of the action 22 to excessive gas pressures and flow rates. In addition, the user can make fine adjustments to the degree of attenuation of the flow-rate and pressure introduced by the flow restrictor device 54, to optimize the attenuation for a particular firearm 10 and suppressor combination. These features also can be used when the user desires to restrict and adjust the flow of the propellant gas G to suit a particular type of cartridge 30.

The flow restrictor device 54 thus facilitates both relatively large changes, and fine adjustments in the characteristics of the propellant gas G reaching the action 22 by way of the gas system 18. The user can effect these changes quickly and easily, without the use of any tooling, and without changing any parts. This feature can be particularly advantageous in military and other applications where a suppressor may need to be installed, or uninstalled under exigent circumstances; or at night or under other low-visibility conditions. Also, the spring-loaded stop 84, in conjunction with the detents 96 formed in the flow restrictor housing 58, give the user a positive tactile indication that the flow restrictor device 54 has been secured in its suppressed or unsuppressed position. In addition, the position of the gas block 25 on the barrel 16 does not need to be changed, and there is no need to change sleeves or orifices to alter the flow of the propellant gas G. Thus, there is minimal potential for jammed or frozen parts, caused by the accumulation of residue from the propellant gas G, to interfere with the proper operation of the flow restrictor device 54. Also, the ability of the user to quickly and easily restrict and adjust the flow of the propellant gas G can reduce the potential for wear and damage to the firearm 10 that can result from operating the firearm 10 in an over-gassed condition.

Alternative embodiments can be configured without the above-noted indexing features that permit the relative positions of the flow restrictor 56 and the flow restrictor housing 58 to be indexed to adjust the degree of attenuation provided by the flow restrictor device 54. In such embodiments, the rearward edge of the flow restrictor does not need to be angled like the rearward edge 106 of the flow restrictor 56, and does not otherwise need to be configured to facilitate relatively fine adjustments in the degree of blockage of the gas block gas port 41.

Also, in embodiments where indexing of the relative positions of the flow restrictor 56 and the flow restrictor housing 58 is used to adjust the degree of attenuation provided by the flow restrictor device 54, the tail of the flow restrictor 56 can have a configuration other than the angled configuration of the tail 104. For example, the tail in such alternative embodiments can have a stepped configuration that results in a varying degree of blockage of the gas block gas port 41 as the angular position of the flow restrictor 56 is varied in relation to the flow restrictor housing 58.

We claim:

1. A gas block assembly configured for mounting on a barrel of a firearm, the barrel defining a bore configured to receive and guide a projectile as the projectile is propelled through the bore by a propellant gas, wherein a first gas port extends between the bore and an exterior surface of the barrel; the gas block assembly comprising:

a gas block defining a first passage configured to receive the barrel, a second passage configured to receive a portion of a gas tube in fluid communication with an action of the firearm, and a second gas port; wherein the second gas port adjoins the second passage, and the gas block is configured so that the second gas port is in fluid communication with the first gas port when the gas block assembly is mounted on the barrel; and wherein the second passage is substantially cylindrical and is defined by an interior surface of the gas block; and a flow restrictor device mounted on the gas block and comprising a flow restrictor, wherein:

at least a first portion of the flow restrictor is positioned within the second passage of the gas block;

the flow restrictor is configured to rotate in relation to the gas block between a first position at which the first portion of the flow restrictor covers only a portion of the second gas port, and a second position;

the first portion of the flow restrictor has an outwardly-facing surface that faces the interior surface of the gas block and has a rounded contour that substantially matches the contour of the interior surface;

the outwardly-facing surface is configured to cover the portion of the second gas port when the flow restrictor is in the first position;

the first portion of the flow restrictor further includes a curvilinear outer edge that adjoins the outwardly-facing surface; and a portion of the outer edge is positioned over the second gas port when the flow restrictor is in the first position.

2. The gas block assembly of claim 1, wherein the flow restrictor does not cover the second gas port when the flow restrictor is in the second position.

3. The gas block assembly of claim 1, wherein:

the first portion of the flow restrictor further includes: an inwardly-facing surface having a rounded contour; a curvilinear inner edge that adjoins the inwardly-facing surface; and a third edge adjoining the inwardly-facing surface and extending in a direction substantially parallel to an axis of rotation of the flow restrictor;

a first end of the outer edge adjoins a first end of the inner edge;

a second end of the outer edge adjoins a second end of the inner edge; and the outer edge and the inner edge define a rearward facing surface of the first portion of the flow restrictor.

4. The gas block assembly of claim 1, wherein the flow restrictor device is configured to rotate about an axis of rotation, and the outer edge of the first portion of the flow restrictor is disposed at an acute angle in relation to the axis of rotation.

5. The gas block assembly of claim 1, wherein the first portion of the flow restrictor has a substantially helical shape.

6. The gas block assembly of claim 2, wherein the first portion of the flow restrictor is configured so that a degree to which the first portion covers the second gas port is related to an angular position of the flow restrictor device in relation to the gas block.

7. The gas block assembly of claim 6, wherein:

the flow restrictor device further comprises a housing;

the flow restrictor further comprises a second portion positioned within the housing and configured to be coupled to the housing for rotation with the housing; and the second portion is further configured to be coupled to the housing in a plurality of different angular positions in relation to the housing.

8. The gas block assembly of claim 7, wherein:

one of the housing and the second portion of the flow restrictor has a plurality of grooves formed therein; and the grooves are configured so that each groove receives an indexing key on the housing or the second portion only when the second portion is positioned in a unique, predetermined angular position in relation to the housing.

9. The gas block assembly of claim 8, wherein the indexing key is mounted on the housing, and the grooves are formed in the second portion of the flow restrictor.

10. The gas block assembly of claim 7, further comprising a tab having a first portion disposed in a third passage formed in the gas block, wherein:

the housing has a groove, a first notch, and a second notch formed therein, the first and second notches adjoining opposite ends of groove;

the housing and the tab are configured so that the first notch aligns with a second portion of the tab and, the tab restrains the housing from rotation in relation to the gas block, when the flow restrictor is in the first position; and the housing and the tab are further configured so that the second notch aligns with the second portion of the tab, and the tab restrains the housing from rotation in relation to the gas block, when the flow restrictor is in the second position.

11. A firearm comprising the gas block assembly of claim 1.

12. A firearm, comprising:

a barrel defining a bore configured to receive and guide a projectile as the projectile is propelled through the bore by a propellant gas produced by the firing of the projectile; and a first gas port extending between the bore and an exterior surface of the barrel;

a gas block defining a first passage configured to receive the barrel; a second passage; and a second gas port; wherein the second gas port adjoins the second passage, and is in fluid communication with the first gas port;

a gas-actuated action;

a gas key in fluid communication with the action;

a gas tube in fluid communication with the second passage of the gas block and the gas key, wherein the first and second gas ports, the second passage, the gas tube, and the gas key define a gas supply path operable to direct a portion of the propellant gas from the bore to the action; and wherein the second passage is substantially cylindrical and is defined by an interior surface of the gas block; and a flow restrictor device mounted for rotation on the gas port and comprising a flow restrictor configured to restrict the flow of the propellant gas through the gas supply passage on a selective basis, wherein:

at least a first portion of the flow restrictor is positioned within the second passage of the gas block;

the flow restrictor is configured to rotate in relation to the gas block between a first position at which the first portion covers only a portion of the second gas port, and a second position;

the first portion of the flow restrictor has an outwardly-facing surface that faces the interior surface of the gas block and has a rounded contour that substantially matches the contour of the interior surface;

the outwardly-facing surface is configured to cover the portion of the second gas port when the flow restrictor is in the first position;

the first portion of the flow restrictor further includes a curvilinear outer edge that adjoins the outwardly-facing surface; and a portion of the outer edge is positioned over the second gas port when the flow restrictor is in the first position.

13. The firearm of claim 12, wherein the flow restrictor does not cover the second gas port when the flow restrictor is in the second position.

14. The firearm of claim 12, wherein:

the first portion of the flow restrictor further includes: an inwardly-facing surface having a rounded contour; a curvilinear inner edge that adjoins the inwardly-facing surface; and a third edge adjoining the inwardly-facing surface and extending in a direction substantially parallel to an axis of rotation of the flow restrictor;

a first end of the outer edge adjoins a first end of the inner edge;

a second end of the outer edge adjoins a second end of the inner edge; and the outer edge and the inner edge define a rearward facing surface of the first portion of the flow restrictor.

15. The firearm of claim 12, wherein the flow restrictor device is configured to rotate about an axis of rotation, and the outer edge of the first portion of the flow restrictor is disposed at an acute angle in relation to the axis of rotation.

16. The firearm of claim 12, wherein:

the flow restrictor device further comprises a housing;

the flow restrictor further comprises a second portion positioned within the housing, the second portion being configured to be coupled to the housing for rotation with the housing; the second portion being further configured to be coupled to the housing in a plurality of different angular positions in relation to the housing; and the flow restrictor is configured so that a degree to which the first portion of the flow restrictor covers the second gas port is related to an angular position of the second portion of the flow restrictor in relation to the gas block.

17. A gas block assembly configured for mounting on a barrel of a firearm, the barrel defining a bore configured to receive and guide a projectile as the projectile is propelled through the bore by a propellant gas, and a first gas port extending between the bore and an exterior surface of the barrel; the gas block assembly comprising:

a gas block defining a first passage configured to receive the barrel; a second passage configured to receive a portion of a gas tube in fluid communication with an action of the firearm; and a second gas port; wherein the second gas port adjoins the second passage, and the gas block is configured so that the second gas port is in fluid communication with the first gas port when the gas block assembly is mounted on the barrel; and a flow restrictor device mounted on the gas block and comprising a flow restrictor and a housing, wherein:

at least a first portion of the flow restrictor is positioned within the second passage of the gas block;

the flow restrictor is configured to rotate in relation to the gas block between a first position at which the first portion of the flow restrictor covers only a portion of the second gas port, and a second position at which the flow restrictor does not cover the second gas port when the flow;

the first portion of the flow restrictor is configured so that a degree to which the first portion covers the second gas port is related to an angular position of the flow restrictor device in relation to the gas block;

the flow restrictor further comprises a second portion positioned within the housing and configured to be coupled to the housing for rotation between a plurality of different angular positions in relation to the housing;

one of the housing and the second portion of the flow restrictor has a plurality of grooves formed therein; and the grooves are configured so that each groove receives an indexing key on the housing or the second portion only when the second portion is positioned in a unique, predetermined angular position in relation to the housing.

18. The gas block assembly of claim 17, wherein:

the second passage is substantially cylindrical and is defined by an interior surface of the gas block;

the first portion of the flow restrictor has an outwardly-facing surface that faces the interior surface of the gas block and has a rounded contour that substantially matches the contour of the interior surface;

the outwardly-facing surface is configured to cover the portion of the second gas port when the flow restrictor is in the first position;

the first portion of the flow restrictor further includes an outer edge that adjoins the outwardly-facing surface; and a portion of the outer edge is positioned over the second gas port when the flow restrictor is in the first position.

19. The gas block assembly of claim 17, wherein the flow restrictor is configured so that when the flow restrictor is in the first position, a rearward edge of the first portion of the flow restrictor aligns with the second gas port.

20. A firearm comprising the gas block assembly of claim 17.

21. A gas block assembly configured for mounting on a barrel of a firearm, the barrel defining a bore configured to receive and guide a projectile as the projectile is propelled through the bore by a propellant gas, and a first gas port extending between the bore and an exterior surface of the barrel; the gas block assembly comprising:

a gas block defining a first passage configured to receive the barrel; a second passage configured to receive a portion of a gas tube in fluid communication with an action of the firearm; and a second gas port; wherein the second gas port adjoins the second passage, and the gas block is configured so that the second gas port is in fluid communication with the first gas port when the gas block assembly is mounted on the barrel; and a flow restrictor device mounted on the gas block and comprising a flow restrictor, wherein:

at least a first portion of the flow restrictor is positioned within the second passage of the gas block;

the flow restrictor is configured to rotate in relation to the gas block between a first position and a second position; and when the flow restrictor is in the first position, a rearward edge of the first portion of the flow restrictor aligns with the second gas port and the first portion of the flow restrictor covers only a portion of the second gas port.

22. The gas block assembly of claim 21, wherein the flow restrictor does not cover the second gas port when the flow restrictor is in the second position.

23. The gas block assembly of claim 21, wherein the first portion of the flow restrictor is configured so that a degree to which the first portion covers the second gas port is related to an angular position of the flow restrictor device in relation to the gas block.

24. A firearm comprising the gas block assembly of claim 21.

* * * * *